US006101630A

United States Patent [19]

Lee

[11] Patent Number: 6,101,630

[45] Date of Patent: Aug. 15, 2000

[54] ADJUSTABLE BRASSIERE WITH FLUID BAGS

[76] Inventor: Shih-Hsiung Lee, No. 9, Lane 451, San-Min Rd. Sec. 3, Feng-Lin Li, Taoyuan City, Taiwan

[21] Appl. No.: 09/397,084

[22] Filed: Sep. 16, 1999

[51] Int. Cl.[7] ..... A41C 3/12

[52] U.S. Cl. ..... 2/57; 2/38; 628/28

[58] Field of Search ..... 450/38, 54–57, 450/61; 623/28

[56] References Cited

U.S. PATENT DOCUMENTS

| | | | |
|---|---|---|---|
| 3,221,748 | 12/1965 | Glasser | 450/57 |
| 3,845,507 | 11/1974 | Kirby et al. | 623/7 |
| 3,934,274 | 1/1976 | Hartley, Jr. | 623/8 |
| 4,125,117 | 11/1978 | Lee | 450/57 |
| 4,790,848 | 12/1988 | Cronin | 623/7 |
| 5,098,330 | 3/1992 | Greenberg | 450/57 |
| 5,334,082 | 8/1994 | Barker | 450/57 |
| 5,607,473 | 3/1997 | Weber-unger et al. | 623/8 |
| 5,823,852 | 10/1998 | Chu | 450/57 |

*Primary Examiner*—Gloria M. Hale
*Attorney, Agent, or Firm*—Bacon & Thomas, PLLC

[57] ABSTRACT

The cups of a brassiere are each provided with two fluid bags, one being filled with a fixed volume of fluid and the other permitting the user to vary the volume of fluid filled therein. The bags of each cup extend outwardly and upwardly at an angle of 40 degrees from the horizontal to define a V-8 the configuration when the brassiere is worn by the user.

4 Claims, 4 Drawing Sheets

ADJUSTABLE BRASSIERE WITH FLUID BAGS

FIELD OF THE INVENTION

The present invention relates to an improved structure for a brassiere, and especially to a brassiere structure by which the breasts of the user will be maintained upright so as to present a beautiful appearance and which is comfortable to wear.

BACKGROUND OF THE INVENTION

The brassiere is used to support the breasts of women and provide both comfort and a beautiful appearance. A known brassiere shown in FIG. 4 is designed with two cups A installed with a soft water bag B and a soft liner C placed in the water bag B with a fluid D filled therein.

Since fluid D is filled in the water bag B, the breasts of the user will be supported upwards. Moreover, since the water bag B is made of soft material and is practical, the user wearing the brassiere will feel comfort. Furthermore, convex particles may be installed in the liner C of the water bag B to provide a massage effect. Therefore, although this brassiere supports the breasts upwards, the user does not feel discomfort so it may be worn for a long time.

However, there are some disadvantages in the aforesaid prior art brassiere. When fluid D is filled in the water bag B and the liner C is directly located in the fluid, the fluid cannot be maintained in position. Therefore, when the fluid D in the water bag B moves due to movement of the user, the liner C will also move and displace or deform itself.

Moreover, the volume of the fluid D in the water bag B is fixed so it cannot meet the requirements of most people. Since the left and right breasts of women have a slight difference, it is required to adjust the size of the brassiere. Though the cup is classified into A, B, C and D sizes, this is still not suitable for many users. Moreover, the manufacture must provide many different materials and this is a heavy burden for the manufacturer.

Since the liner C and fluid D in the water bag have their own weight, each cup A of the brassiere will be affected by the additional weight so that the lower edge of the cup will descend and deform the shape of the brassiere.

SUMMARY OF THE INVENTION

Accordingly, the primary object of the present invention is to provide an improved structure of a brassiere. The user wearing the brassiere will feel comfortable, and the breasts of the user will be supported upwards. Water bags are fixed in the cups at outwardly inclined angles of 40 degrees and are not easily moved or deformed. Thus, the breasts of the user will be maintained upright to present a beautiful appearance.

Another object of the present invention is to provide a structure of a brassiere wherein the left and right side water bags may be adjusted by the user to accommodate any imbalance of the breast.

A further object of the present invention is to provide a structure of a brassiere wherein, when fluid is not filled in the water bag, the brassiere becomes an adjustable brassiere.

A still further object of the present invention is to provide a structure of a brassiere having a packet for receiving a water bag that is seamed in the cup. The water bag is detachable and arrangeable in the cup.

A yet another object of the present invention is to provide a convenient and light weight brassiere.

In order to achieve the aforesaid objects, a structure of a brassiere is disclosed, wherein a soft fluid bag assembly is installed within each cup of a brassiere. Fluid is filled in the bag assembly. The fluid in the bag assembly may be a liquid, air, or a semi-solid material. The bag assembly includes an adjustable fluid bag and a fixed fluid bag. The adjustable bag is shaped with a cubic or three-dimensional shape according to the requirements of ergonomics. The fixed bag is filled with a fluid and is installed at the lower section inside the bag assembly. The bag assembly is inclined outwards and upwards at an angle of 40 degrees and define a V-shaped configuration. A filling opening protrudes out of the cup and is installed at a desired location on the bag assembly, for example, at the lower side of the cup near the arm pit of the user or at the middle portion between the two cups. The user may vary the amount of fluid in the adjustable bags for adjusting the volumes of the cups so that the right and left breasts will each have the same final volume. In order to reduce the weight of the brassiere and permit its convenient adjustment, the fluid in the adjustable bags is preferably air.

The various objects and advantages of the present invention will be more readily understood from the following detailed description when read in conjunction with the appended drawings.

DETAILED DESCRIPTION OF THE PREFERRED EMBODIMENTS

Figure 1:
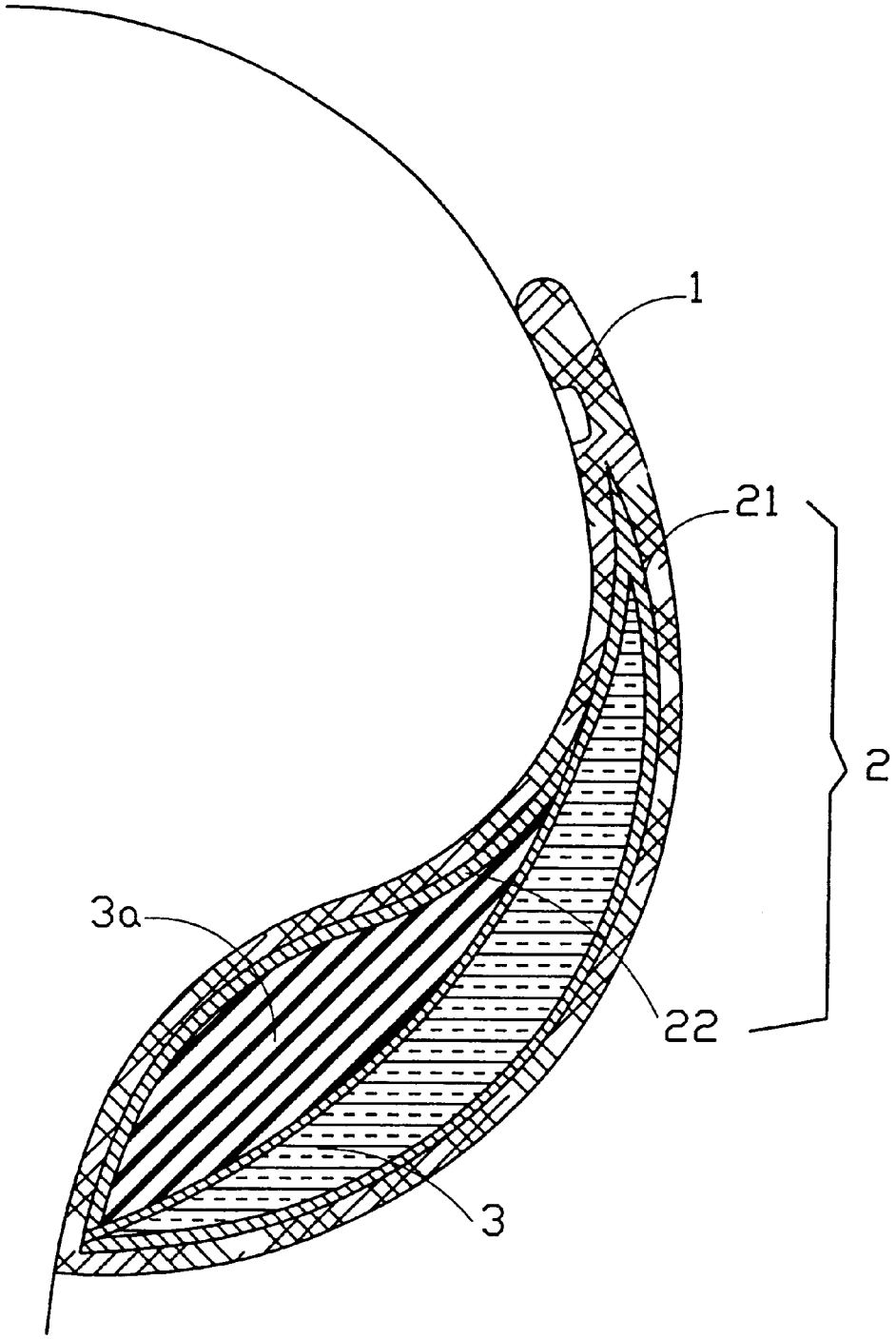
FIG. 1 is a cross sectional view of the present invention.
Figure 2:
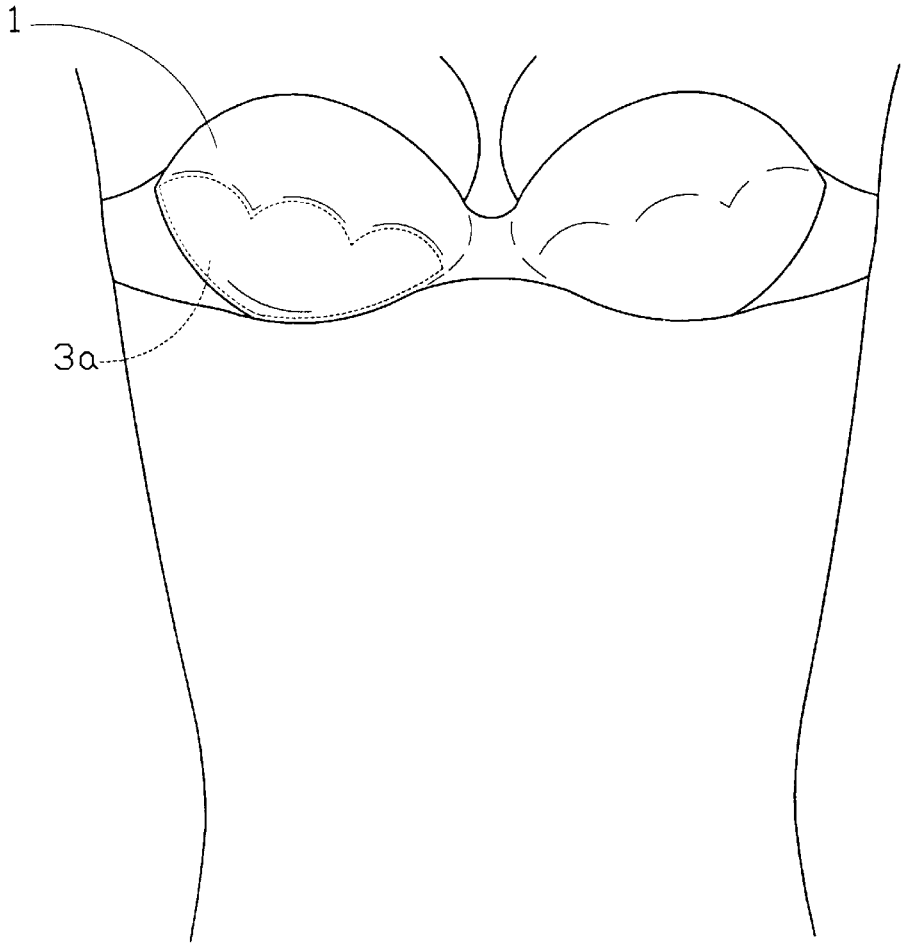
FIG. 2 is a schematic front view showing the present invention being worn by a user and depicting the V-shaped configuration defined by the two bag assemblies.

Referring to FIGS. 1 and 2, the brassiere of the present invention is illustrated therein. A soft fluid bag assembly 2 is installed within the cup 1 of a brassiere. A fluid 3 is filled in the bag assembly 2. The fluid 3 may be a liquid, air or a semi-solid material. The bag assembly 2 includes an adjustable fluid bag 21 containing fluid 3 and a fixed fluid bag 22. The adjustable bag 2 is of a cubic or three-dimensional shape according to the requirements of ergonomics. The fixed bag 22 is also filled with a fluid 3*a* according to the requirements of ergonomics and is installed at the lower inner section of bag 21. The fluid 3*a* is preferably of a glutinous material in this embodiment. In the integral assembly, as seen in FIG. 2, the bag assemblies 2 are inclined outwards and upwards at angles of 40 degrees from the horizontal to form a V-shaped configuration.

When the aforesaid structure is used, fluid 3*a* within the cup 1 is installed in the fixed bag 22 at the lower end of the bag assembly 2. Fluid filled in the adjustable bag 21 may be air, a liquid, or a semi-liquid. Moreover, since the bag assembly 2 is fixed in the cup 1 at an inclined angle of 40 degrees, when the user wears the brassiere, the bag assemblies 2 in the brassiere will support the breasts in upward and inward directions to present a beautiful appearance. When no fluid 3 is filled in the adjustable bag 21, the brassier is used as a fixed type adjustable brassiere.

In the aforesaid structure, the fixing of the bag assembly 2 includes a packet receiving bag assembly 2 that is seamed in the cup 1. The bag assembly 2 is detachable and selectively arranged in the cup 1. One-half of the bag assembly 2 is seamed directly in the cup 1.

Furthermore, since fluid 3 and 3*a* are filled in the bag assembly 2, the latter is deformable and soft, and will cause cup 1 to adhere tightly and conform to the breast. The fluid 3 in the adjustable bag 2 will cause a uniform application of pressure to the breast and provide comfort to the user. Moreover, since bag assembly 2 is fixed in the cup 1 at an inclined angle of 40 degrees, and the fixed bag 22 is fixed to the lower side of the adjustable bag 21, they will not move about freely. Therefore, the breast will be supported upwards and inwards to present a beautiful and natural appearance.

Figure 3:
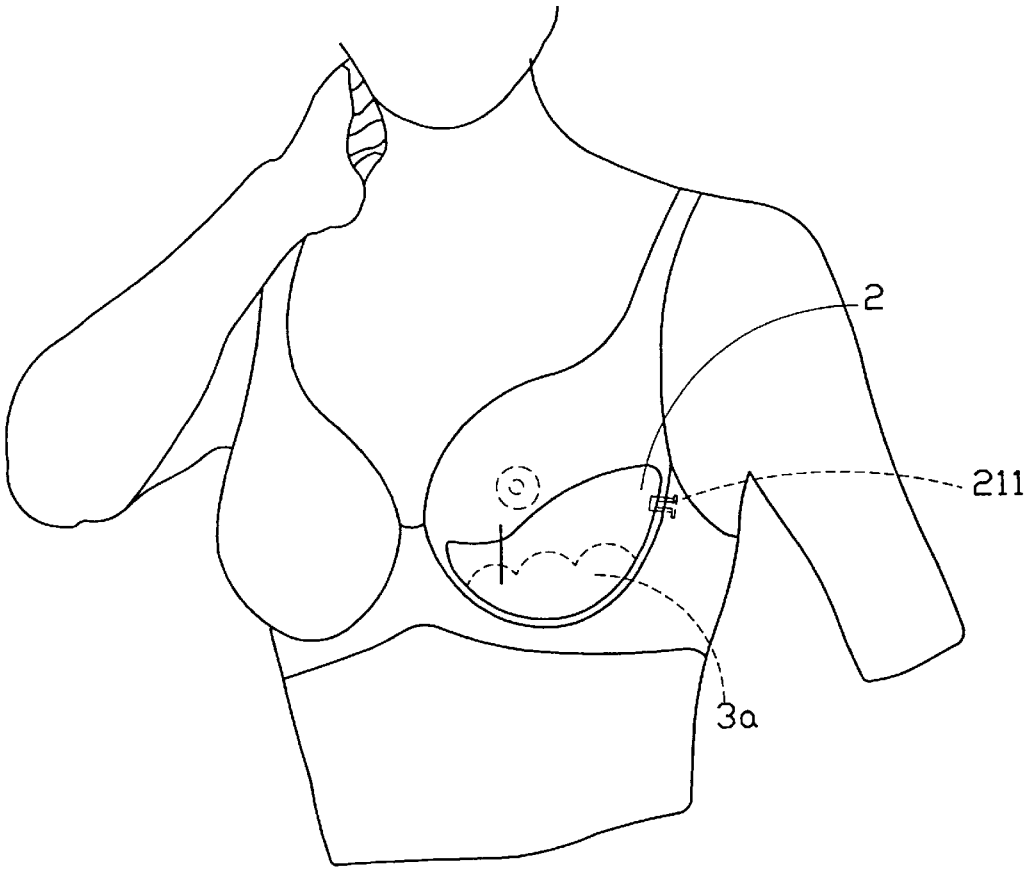
FIG. 3 also shows the invention being worn by user and location of the fluid filling opening.
Figure 4:
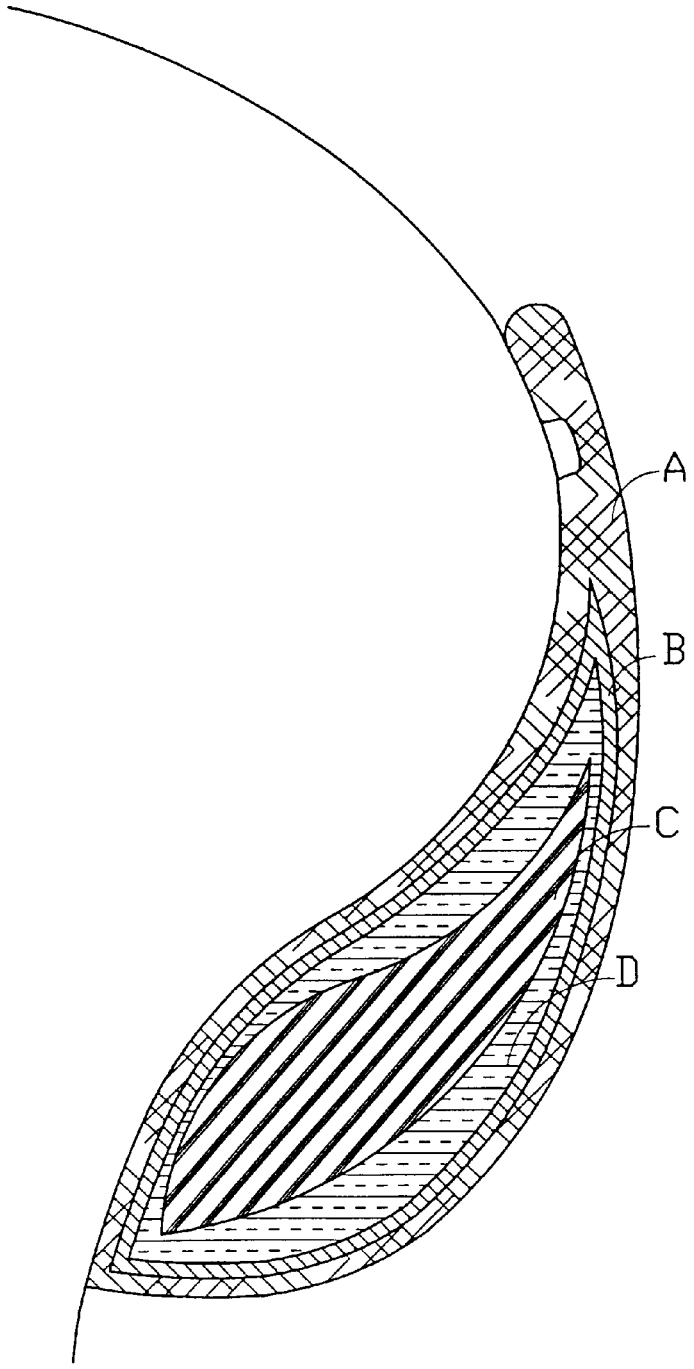
FIG. 4 (PRIOR ART)
FIG. 4 is a cross sectional view showing a prior art structure.

With reference to FIG. 3, a filling opening 211 protrudes out of the cup 1 and is installed with each adjustable bag 21. The filling opening 211 may be installed at the lower side of the cup 1 near the armpit of the user or at the middle portion of the brassiere between cups 1. The user may adjust the volume of fluid in the water bags 21 according to the volumes of the breasts so that both the right and left breast will have similar final volumes. In order to reduce the weight of the brassiere and to permit its convenient adjustment, the fluid 3 in the adjustable bags 21 is preferably air.

As described above, since the shapes of breasts among women are different, even the right and left breasts of a woman may have different volumes, the upward supporting of the breast is preferably adjusted by the user herself. Therefore, in embodying the present invention, a small section of the filling opening 211 of the water bag 21 may protrude from the cup 1 so that the user may connect opening 211 to an inflation ball to either fill air into the bag 21 or vent air from bag 21. Thus, the user may adjust the supporting level of the bag 21.

The fluid volume of the bag 21 can be adjusted from the filling opening 211. The fixed bag 22 is tightly adhered to the lower side of the bag 21. Therefore, only a little fluid 3*a* is necessary to fill in the bag 21, about two-third of its volume. Thus, the bag assembly 2 will not be too large or too heavy so as to cause it to deform. Therefore, the cup 1 of the present invention will have a beautiful and natural appearance.

Although the present invention has been described with reference to its preferred embodiments, it will be understood that the invention is not limited to the details described, and that various substitutions and modifications will become apparent to those of ordinary skill in the art. Therefore, all such substitutions and modifications are intended to be embraced within the scope of the invention as defined in the appended claims.

What is claimed is:

1. An adjustable brassiere comprising:

a) a pair of cups for supporting the breasts of a user;

b) each cup including a fluid bag assembly disposed therein, the bag assembly being defined by an outer adjustable bag for receiving a variable volume of fluid and an inner-fixed bag containing a fixed volume of fluid therein; and c) the bag assemblies each being inclined upwardly and outwardly at an angle of about 40 degrees to define a substantially V-shaped configuration when the brassiere is worn by the user.

2. The adjustable brassiere of claim 1 wherein each adjustable bag includes a filling opening extending outwardly from a lateral edge of the cup.

3. The adjustable brassiere of claim 1 wherein the fluid in either the adjustable or fixed bag is a liquid, air or a semi-solid material.

4. The adjustable brassiere of claim 1 wherein each cup further includes a packet seamed therein and each bag assembly being detachably disposed within the cup.

* * * * *